US006337640B2

(12) United States Patent
Lees

(10) Patent No.: US 6,337,640 B2
(45) **Date of Patent: *Jan. 8, 2002**

(54) INDUCTIVE LOOP SENSOR FOR TRAFFIC DETECTION, AND TRAFFIC MONITORING APPARATUS AND METHOD USING SUCH A LOOP SENSOR

(75) Inventor: Robert Harper Lees, Buckinghamshire (GB)

(73) Assignee: Diamond Consulting Services Limited, Buckinghamshire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/282,371

(22) Filed: Mar. 31, 1999

(51) Int. Cl.[7] ..... G08G 1/01

(52) U.S. Cl. ..... 340/933; 340/919; 340/931; 340/935; 340/941

(58) Field of Search ..... 340/933, 931, 340/941, 935, 919; 200/85 R, 86 A, 86 R; 324/236, 238

(56) References Cited

U.S. PATENT DOCUMENTS

| | | | | | |
|---|---|---|---|---|---|
| 2,525,824 | A | * | 10/1950 | Nagel | 235/92 |
| 3,184,730 | A | * | 5/1965 | Irish | 340/258 |
| 3,312,935 | A | | 4/1967 | Brothman et al. | 340/38 |
| 3,651,452 | A | * | 3/1972 | Friedman | 340/38 L |
| 3,688,308 | A | | 8/1972 | Makoto et al. | 340/38 |
| 3,835,449 | A | | 9/1974 | Viracolo | 340/38 |
| 3,983,531 | A | | 9/1976 | Corrigan | 340/31 R |
| 3,984,764 | A | * | 10/1976 | Koerner | 324/41 |
| 4,134,464 | A | * | 1/1979 | Johnson et al. | 177/3 |
| 4,430,636 | A | * | 2/1984 | Bruce | 340/941 |
| 4,529,982 | A | * | 7/1985 | Karlstrom et al. | 340/991 |
| 4,661,799 | A | * | 4/1987 | Buttemer | 340/941 |
| 4,945,356 | A | | 7/1990 | Henderson et al. | 340/941 |
| 5,614,894 | A | * | 3/1997 | Stanczyk | 340/933 |

FOREIGN PATENT DOCUMENTS

| | | | | |
|---|---|---|---|---|
| DE | 22 32 335 | * | 1/1974 | |
| DE | 3100724 A1 | | 7/1982 | |
| DE | 3632316 A1 | | 3/1988 | |
| EP | 0 035 960 A1 | | 3/1981 | |
| FR | 1555538 | | 12/1968 | |
| FR | 2254842 | | 12/1973 | |
| FR | 2 549 625 A1 | | 7/1983 | |
| GB | 410 527 | | 5/1934 | |
| GB | 1245360 | | 9/1971 | |
| GB | 1272534 | | 5/1972 | |
| SE | 673505 | * | 6/1952 | 37/9 |

* cited by examiner

*Primary Examiner*—Jeffery Hofsass
*Assistant Examiner*—Son M. Tang
(74) *Attorney, Agent, or Firm*—Westman, Champlin & Kelly, P.A.

(57) ABSTRACT

An inductive loop sensor for detecting vehicles travelling along a lane of a roadway comprises a figure-of-eight conducting loop. The loop is arranged with its three segments transversely across the roadway to detect the wheels of vehicles travelling along the roadway. The length of the loop in the direction of travel along the roadway is less than 60 cms. Traffic monitoring apparatus energises the loops and detects the passage of vehicle wheels over the loops to provide for the classification of vehicles by axle count.

13 Claims, 1 Drawing Sheet

FIG. 1.
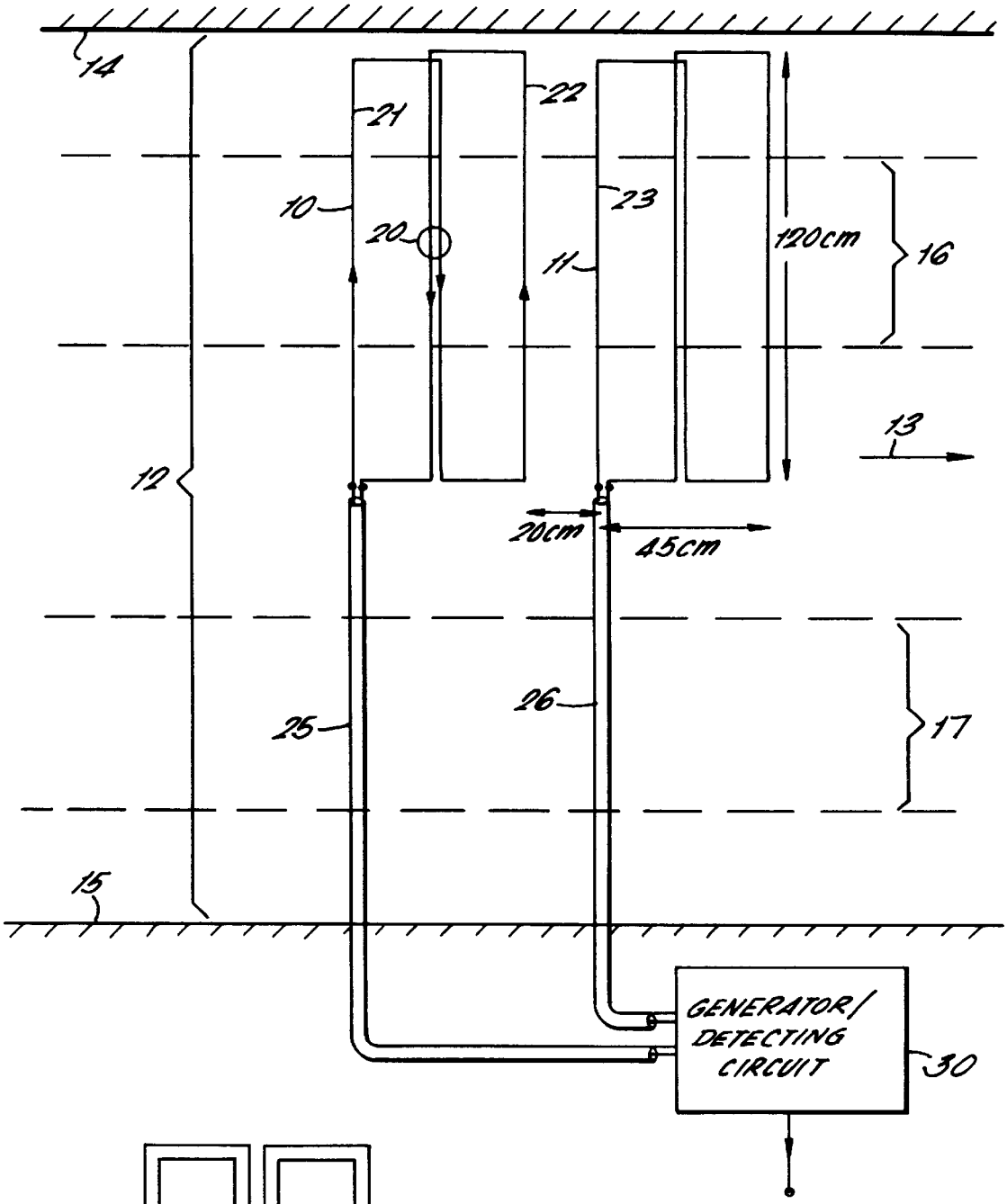
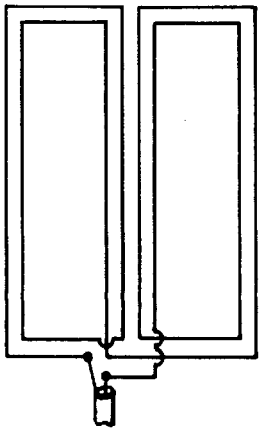
FIG. 2.

INDUCTIVE LOOP SENSOR FOR TRAFFIC DETECTION, AND TRAFFIC MONITORING APPARATUS AND METHOD USING SUCH A LOOP SENSOR

FIELD OF THE INVENTION

The present invention relates to inductive loops for traffic detection. The invention is also concerned with traffic monitoring apparatus comprising at least one of such inductive loops for detecting and potentially classifying traffic passing over the loop.

BACKGROUND OF THE INVENTION

Inductive loops for traffic detection are well known and used commonly for monitoring traffic flow along the lanes of roadways. Typically, a loop may comprise a rectangular outline loop of conductor buried just beneath the surface of the roadway and connected to energising and detecting equipment at the side of the roadway. The loop is energised with alternating current at a selected frequency to produce a corresponding alternating magnetic field in the space above the loop. Vehicles passing over the loop affect the inductance of the loop which can be detected by the detection equipment. Typical prior art loops comprise a single rectangular winding having a length, in the distance of travel of vehicles along the roadway lane, which may be a substantial proportion of the length of vehicles travelling along the roadway, say 1 meter or more, and a width transversely of the direction of travel only slightly less than the width of the roadway lane. The detection signal produced in such inductive loops responds to the metal mass of a vehicle passing over the loop, particularly the engine and drive train, and also chassis components of longer vehicles. For detection of vehicles as a whole, loops are designed to ensure a good detection signal is achieved as the vehicle passes by. U.S. Pat. No. 3,983,531 discloses a typical inductive loop sensor roadway installation of this kind.

There is also a requirement to count the number of axles of vehicles passing along a roadway, so that multi axle vehicles for example can be distinguished from ordinary domestic automobiles for example. Accordingly, loops have been designed which are intended to be specifically sensitive to the axles, or more particularly to the wheels, of vehicles passing over the loop. U.S. Pat. No. 5,614,894 discloses a wide variety of inductive loops used for the detection of the wheels of vehicles passing along the roadway. A separate loop may be used for each wheel track in each lane of the roadway and the patent indicates that the overall length of the loops in the direction of traffic movement should be relatively short, comparable to the footprint on the roadway of the vehicle wheels to be detected by the loops. The patent suggests a length in the traffic direction of 15 cms for loops intended to detect the wheels of domestic automobiles, and 30 cms for loops intended for detecting the wheels of trucks.

It is an object of the present invention to provide a further inductive loop sensor design, specifically adapted for the detection of the wheels of vehicles passing over the loop, which can have a general purpose application to all kinds of vehicles using the roadway.

SUMMARY OF THE INVENTION

Accordingly the present invention provides an inductive loop sensor for detecting vehicles travelling along the lane of a roadway. The sensor comprises a continuous conductive loop configured to have a central conducting segment and outer conducting segments spaced on opposite sides of the central segment. An electric current in the loop flows in a first transverse direction along the central segment and in a second transverse direction opposite to the first transverse direction along each of the outer segments. The loop is aligned on the roadway lane so that the central and outer segments are transverse to the traffic flow direction in the lane. The distance between the outer segments of the loop are selected to be not greater than about 60 cms.

The resulting loop can provide, when energised, a magnetic field which extends above the roadway by no more than about 30 cms. In this way, the sensor can be made relatively less sensitive to the passage over the loop of the main bulk of vehicles, particularly engine, drive train and large chassis members. By comparison, the loop will respond specifically to metal components of the wheels of the vehicle travelling on or just above the roadway surface. In particular the loop will respond to the steel bracing in steel braced tyres, or alteratively to the metal of the wheel and wheel hub itself.

Importantly, a single size of loop can be used for detecting both domestic automobile wheels and also the wheels of large trucks.

The loop could be wide enough to cover an entire lane but preferably has a width across the traffic flow direction of between about 100 and about 140 cms. Conveniently, the width of the loop across the traffic flow is less than that which would allow the wheels at both ends of an axle of a vehicle to be detected simultaneously by the loop. A width of loop of about 120 cms is considered appropriate.

Preferably the distance between the outer segments of the loop is about 45 cms. This then gives good discrimination between the effect of a wheel and the influence of the engine/drive train/chassis of a vehicle which passes over the loop just outside the influence of the magnetic field.

The central segment of a loop should be symmetrically located between the outer segments.

The loop may be configured as a figure-of-eight, or as a pair of multiturn windings of opposite hand connected in series.

The invention also provides traffic monitoring apparatus comprising at least a first inductive loop sensor, a generator to energise this first loop sensor with a detection signal and a detector responsive to changes in the detection signal in the loop sensor to provide an indication of a vehicle crossing the loop sensor. The loop sensor comprises a continuous conductive loop as described above.

In a further embodiment the apparatus comprises a second inductive loop sensor having the same form as the first sensor, where the first and second sensors are aligned spaced apart one after the other along the roadway lane in the traffic flow direction. The generator energises both the first and second sensors with respective detection signals and the detector is responsive to changes in these signals in each of the sensors to provide an indication of the direction of travel.

The loop sensors may have similar dimensions and neighbouring outer segments of the two loop sensors are typically spaced apart in the traffic flow direction by between 15 and about 25 cms.

The invention still further contemplates a method of counting the number of axles of vehicles travelling along a lane of a roadway, in which, at least one inductive loop sensor in the form of a continuous conductive loop as described above is installed on or in a surface of the roadway lane. This sensor is energised with a detection signal to generate a magnetic field which extends above the surface of the roadway lane by not more than about 30 cms. Changes in the detection signal corresponding to the passage of vehicle wheels over the loop are detected.

BRIEF DESCRIPTION OF THE DRAWING

An example of the present invention will now be described with reference to the accompanying drawings in which FIG. 1 is a schematic plan view of a vehicle axle detection station along a lane of a roadway; and FIG. 2 is a schematic plan view of a different configuration of loop embodying the invention.

DETAILED DESCRIPTION OF THE PREFERRED EMBODIMENT

In FIG. 1, the position is illustrated of two successive loop sensors 10 and 11 along a lane 12 of a roadway. The normal direction of travel of vehicles along the lane 12 is illustrated by the arrow 13. The lane 12 of the roadway is shown between lateral boundaries 14 and 15. It should be understood that these boundaries 14 and 15 need not be physical boundaries, but merely the demarcations of the lane on a wider roadway.

The lane is essentially wide enough to accommodate normal traffic vehicles including large goods vehicles and trucks. The normal rolling tracks of the wheels of vehicles travelling along the lane 12, are illustrated at 16 and 17 between the pairs of parallel dotted lines in the drawing.

Loop sensors 10 and 11 are located on the roadway so as to be substantially centred relative to the wheel running track 16 of the roadway. The two loop sensors 10 and 11 are, as illustrated, located spaced apart one after the other in the direction 13 of travel along the roadway lane 12.

The two loop sensors 10 and 11 are substantially identical, and each sensor comprises a figure-of-eight conductive loop having a transversely extending central conducting segment 20 and outer conducting segments 21, 22 on opposite sides of a central segment 20. Because of the figure-of-eight construction of the loop 10, it can be seen that a current in the loop flows in the central segment 20 transversely across the roadway in a first direction, and flows in the outer segments 21 and 22 transversely in the opposite direction.

Each of the loops 10 and 11 are substantially identical in form and each have a total length, in the direction 13 of travel along the roadway which is typically about 45 cms. The loop is formed symmetrically on either side of the central segment 20 so that the two halves of the loop are of substantially the same area. The loop has a width of about 120 cms transversely across the wheel running path 16 on the roadway.

The effect of the construction illustrated is to confine the magnetic field produced by signal currents flowing in the loop to a height above the roadway of not significantly more than about 22 cms.

The neighbouring outer segments 22 and 23 of the two loops illustrated in the drawing are spaced apart in the direction of travel 13 by about 20 cms.

In the drawing, each of the loops 10 and 11 is illustrated as a single figure-of-eight winding of conductor. It will be understood that the loops may be formed of multiple windings repeatedly following the track of the single winding illustrated. In a different embodiment, the loops 10 and 11 may be configured as separate multiple turn windings of opposite hand connected in series. Such an arrangement is illustrated in FIG. 2, which shows a pair of two turn windings connected in series to provide the same electrical effect as a repeated figure-of-eight loop. Typical loops comprise three turns in each winding.

In any case, each of the loops 10 and 11 is connected via connecting cables 25 and 26 to a generator and detector circuit mounted on the side of the roadway. The loops 10 and 11 may be buried a short distance, typically 1 to 4 cms beneath the surface of the roadway. The connecting cables 25 and 26 are also buried beneath the roadway surface.

The generator and detector circuit 30 includes a generator for supplying an alternating current signal to the loops 10 and 11 via the connecting cables 25 and 26. As a vehicle wheel passes over either of the loops 10 and 11 the inductance of the loop changes so that the amplitude (or frequency) of the signal in the loop changes. This change is detected by the detecting circuitry in the roadside equipment 30, to indicate the passage of a vehicle wheel over the loop.

By providing two loops 10 and 11 as illustrated, the direction of travel of a vehicle along the roadway lane can be determined from the timing of the responses in the two loops to a single wheel travelling over the loops.

The loop sensors constructed and energised as described above, are capable of reliably distinguishing the individual wheels of vehicles travelling over the loops, from any residual response resulting from the massive metal components of the vehicle, such as the engine, drive train or chassis. This is due to the way in which the loop design constrains the field produced by the loop to extend only a limited distance above the roadway surface.

The height to which the magnetic field from a loop sensor extends above the road surface is determined by the overall length of the sensor.

In the preferred embodiment, the width of each loop sensor is set so as to ensure that the wheels at opposite ends of an axle of a vehicle could not both be detected by the same sensor at the same time. Thus, the width across the carriageway, of each sensor loop is set to be somewhat less than the track width of smaller domestic automobiles. However, the width of each loop sensor is wide enough to accommodate both of the double wheels (at one end of an axle) typically employed by large trucks. The generator and detecting circuit 30 is arranged to identify the different response resulting from the passage over the sensor loops of a single wheel compared with that for a double wheel. In this way the category of vehicles passing over the sensor can be classified.

Although the drawing shows loop sensors 10 and 11 along only one of the rolling track 16 within a lane 12 of the roadway, it should be understood that an additional pair of loop sensors may also be provided across the other rolling track 17 of the lane 12. Also, the loop sensors 10 and 11 may be used in combination with other loop sensors of standard design for detecting the bulk metal parts of vehicles passing along the roadway lane.

What is claimed is:

1. An inductive loop sensor for detecting vehicles travelling along a lane of a roadway, the sensor comprising a continuous conductive loop, the loop being configured to provide a central conducting segment and outer conducting segments spaced on opposite sides of said central segment, whereby an electric current in the loop flows in a first transverse direction along said central segment and in a second transverse direction opposite to said first transverse direction along each of said outer segments, wherein said loop is aligned on said roadway lane so that said central and outer segments extend transverse to the traffic flow direction in said lane, the distance between the outer segments of the loop being not greater than 60 cms.

2. An inductive loop sensor as claimed in claim 1, wherein said loop has a width across the traffic flow direction of between about 100 and about 140 cms.

3. An inductive loop sensor as claimed in claim 2, wherein said width of the loop is about 120 cms.

4. An inductive loop sensor as claimed in claim 1, wherein said distance between the outer segments is about 45 cms.

5. An inductive loop sensor as claimed in claim 1, wherein said central segment is symmetrically located between said outer segments.

6. An inductive loop sensor as claimed in claim 1, wherein said loop is configured as a figure-of-eight.

7. An inductive loop sensor as claimed in claim 1, wherein said loop is configured as a pair of multiturn windings of opposite hand connected in series.

8. Traffic monitoring apparatus comprising at least a first inductive loop sensor, a generator to energise said first loop sensor with a detection signal, and a detector responsive to changes in the detection signals in the loop sensor to provide an indication of a vehicle crossing the loop sensor, wherein the loop sensor comprises a continuous conductive loop having a central conducting segment and outer conducting segments spaced on opposite sides of said central segment, whereby an electric current in the loop flows in a first transverse direction along said central segment and in a second transverse direction opposite to said first transverse direction along each of said outer segments, wherein said loop is aligned on said roadway lane so that said central and outer segments extend transverse to the traffic flow direction in said lane, the distance between the outer segments of the loop being not greater than 60 cms.

9. Traffic monitoring apparatus as claimed in claim 8, further comprising a second said inductive loop sensor having the same form as said first sensor, said first and second sensors being aligned spaced apart one after the other along the roadway lane in the traffic flow direction, said generator adapted to energise both said first and second sensors with respective detection signals, and said detector being responsive to changes in said signals in each of the sensors to provide an indication of the direction of travel of a vehicle crossing the sensors.

10. Traffic monitoring apparatus as claimed in claim 9, wherein said first and second loop sensors have similar dimensions and neighbouring outer segments of the two loop sensors are spaced apart in the traffic flow direction by between about 15 cms and about 25 cms.

11. A method of counting the number of axles of vehicles travelling along a lane of roadway comprising, installing on or in a surface of the roadway lane at least one inductive loop sensor in the form of a continuous conductive loop having a central conducting segment and outer conducting segments spaced on opposite sides of said central segment, whereby an electric current in the loop flows in a first transverse direction along said central segment and in a second transverse direction opposite to said first transverse direction along each of said outer segments, wherein said loop is aligned on said roadway lane so that said central and outer segments are transverse to the traffic flow direction in said lane, the distance between the outer segments of the loop being not greater than about 60 cms.

energising said sensor with a detection signal to generate a magnetic field which extends above the surface of the roadway lane by not more than about 30 cms, and detecting changes in said detection signal corresponding to the passage of vehicle wheels over the loop.

12. A method as claimed in claim 11, wherein said distance between outer segments of the loop is about 45 cms, and the magnetic field extends above the surface by about 22 cms.

13. A method as claimed in claim 11, wherein said loop has a width across the traffic flow direction such as to detect the wheel or wheels of a vehicle only at one end of each vehicle axle and the level of change in said detection signal is used to indicate the number of wheels being detected simultaneously.

* * * * *